United States Patent [19]

Pierce, Jr.

[11] Patent Number: 4,600,022

[45] Date of Patent: Jul. 15, 1986

[54] COMPOSITE SMOKER'S KIT

[76] Inventor: Howard E. Pierce, Jr., 47 Marine St., Thomaston, Conn. 06787

[21] Appl. No.: 700,481

[22] Filed: Feb. 11, 1985

[51] Int. Cl.[4] ..... A24F 9/10; A24F 13/24

[52] U.S. Cl. ..... 131/243; 131/246; 131/247; 131/249; 131/253

[58] Field of Search ..... 131/329, 243, 247, 249, 131/242, 248, 246, 250, 251; 431/253; 206/234, 236

[56] References Cited

U.S. PATENT DOCUMENTS

| | | | |
|---|---|---|---|
| 827,558 | 7/1906 | Niell | 131/249 |
| 936,678 | 10/1909 | Sommer | 131/248 |
| 1,526,938 | 2/1925 | Sommer et al. | 131/243 |
| 1,594,311 | 7/1926 | Ludasy | 131/243 |
| 1,757,607 | 5/1950 | Zullo | 131/249 |
| 2,536,852 | 1/1951 | Middleton | 131/243 |
| 2,633,137 | 3/1953 | Narragon | 131/243 |
| 2,828,855 | 4/1958 | Mosch | 431/253 |
| 4,043,348 | 8/1977 | Kanady | 131/243 |

*Primary Examiner*—V. Millin
*Assistant Examiner*—H. Macey

[57] ABSTRACT

A composite smoker's kit for preparing a pipe or a cigar for smoking. The kit is readily adaptable to the body portion of a lighter mechanism to enable easy transfer from a spent lighter mechanism to a fresh lighter mechanism and thereby enjoy a long lifetime of use. The kit features smoker's tools which are compactly mounted on a spring clip of the kit. The tools are detented on the lighter body when not in use but can be conveniently pivoted to operational position when desire is to use the tools.

4 Claims, 6 Drawing Figures

COMPOSITE SMOKER'S KIT

BACKGROUND OF THE INVENTION

1. Field of the Invention

This invention relates to the attachment of smoker's tools to a cigarette, cigar or pipe lighter mechanism. In another aspect, the present invention relates to smoker's tools that readily mount onto lighter mechanism by means of a novel spring clip on which the smoker's tools are securely and functionally positioned. In still another aspect of the invention, the tools comprise a relatively inexpensive but useful smoker's kit that preferably mounts onto what is commonly known as a disposable or throw-away lighter of the type marketed by BIC Corporation of Milford, Conn.

2. Brief Description of the Prior Art

Adaptation of smoker's kits to lighter mechanisms are known in the prior art. A representation sampling of prior art devices of the type may be seen in U.S. Pat. Nos. 3,777,766 and 4,043,348, both to Garland H. Kanady and 3,220,420 to Jean Genoud. Each patent referred to generally discloses a retractable pipe tamp attached to a lighter mechanism. U.S. Pat. No. 3,200,822 to Edgar D. Meyer discloses a "built-in" pipe smoker's tamp and pick which are pivotal and mount within a hinged cover of a lighter mechanism. U.S. Pat. No. 2,894,515 to Eli F. Wismer, Jr. discloses a slideable tamp and pick arrangement which are "built-in" accessories. U.S. Pat. No. 2,633,137 to Paul E. Narragon discloses a pivotal tamp and pick also "built-in" to the lighter. U.S. Pat. No. 2,539,249 to Cecil C. Holland discloses a reusable backing plate which clamps to the end portion of a packet of what is commonly known as book matches. The backing plate incorporates a pivotal arm which is equipped with a tobacco tamping head.

SUMMARY OF THE INVENTION

The present invention is considered a significant improvement over the known prior art by virtue of its facile adaptability and interchangeability to the housing of a disposable lighter mechanism whereby the unit may repeatedly serve as a composite smoker's tool. The novel arrangement can be a great convenience to smokers who carry such a lighter to have all the equipment necessary to perform a particular function all in one handy kit. And when replacing the spent lighter (when out of fuel) with a fresh one the kit is readily transferred and will serve the user over a very long period of time.

The kit may take the form of a useful adapter for pipe smokers or, in a modified form, a convenient adapter for cigar smokers. In either form, the apparatus is simple and inexpensive to manufacture and is snugly and compactly mounted on the housing of the lighter mechanism. When in use the tool portions are readily pivotal from a non-functional to a functional position.

DETAILED DESCRIPTION OF THE INVENTION

Figure 1:
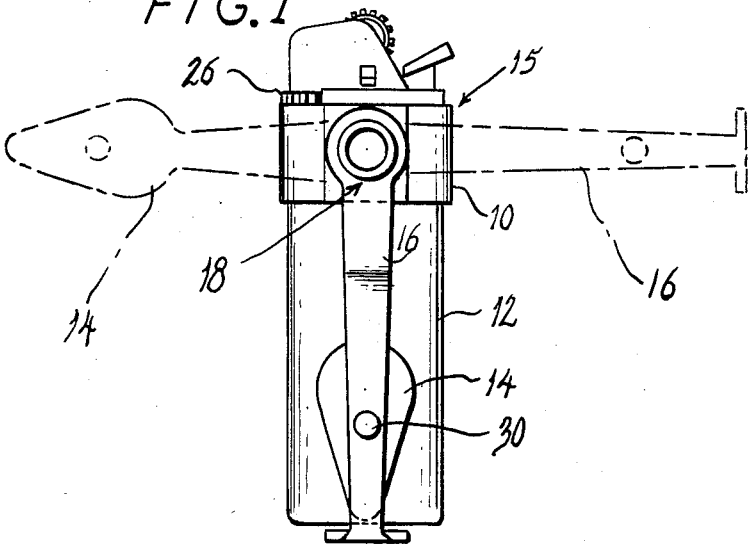
FIG. 1 is a side elevational view of an oval-shaped lighter illustrating the novel pipe smoker's tool kit mounted thereon; the dot and dash lines illustrating the spade and tamp portions of the kit in operational position.
Figure 2:
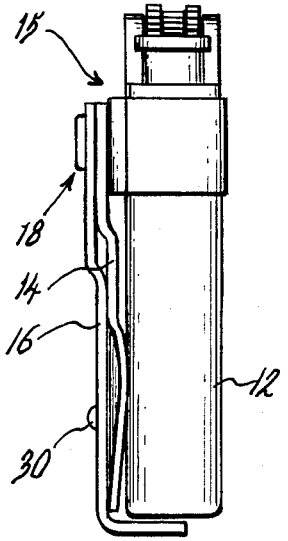
FIG. 2 is a front elevational view of the apparatus of FIG. 1 showing the elements in rest or home position.
Figure 3:
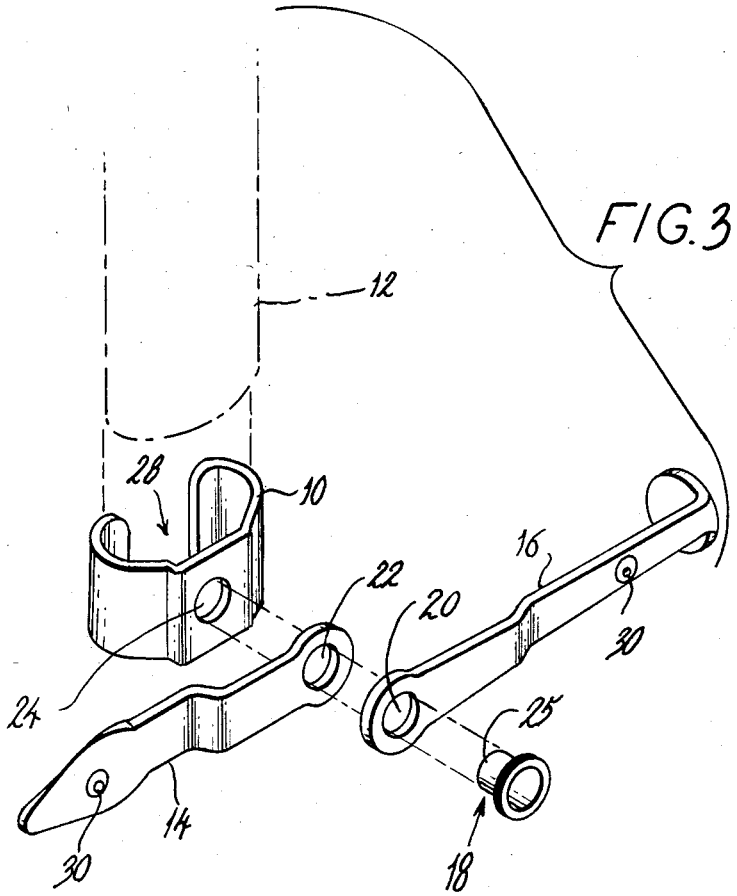
FIG. 3 is an exploded perspective view illustrating the pertinent elements of the invention; the lower portion of the lighter mechanism housing indicated in dot and dash lines.

With reference to the drawing, and particularly to FIG. 3, an open clip 10 is of spring metal material and is formed such that it must be forced open or slightly expanded as it frictionally mounts on the body 12 of a disposable lighter mechanism, generally designated 15. A spade 14 and a tamp 16 pivotally mount on spring clip 10 by means of an eyelet 18 which snugly fits into bores 20, 22 and 24 of tamp 16, spade 14 and spring clip 10, respectively. With the spring clip, spade and tamp elements so arranged a portion 25 of eyelet 18 is rolled over, in a well known manner, at the inner portion of spring clip 10. Accordingly, spade 14 and tamp 16 are snugly mounted on spring clip 10 whereby both spade and tamp may be rotated from non-functional to functional positions (FIG. 1) and, by means of their snug fit on eyelet 18, held in either position. The spring clip 10 of the assembled kit is then entered at the lower portion of the lighter body 12 and forced upwardly to home position determined by the flame adjusting wheel 26 of the lighter mechanism. It should be noted that spring clip 10, by virtue of an open, rear portion indicated at 28 permits ease of the kit assembly and facile entry and removal of the kit. Small ball-like protrusions or dimples 30 on spade 14 and tamp 16 serve to hold those members detented in the non-functional, out-of-the-way, position illustrated in full lines in FIGS. 1 and 2. Moreover, spade 14 is so formed not only to serve as a pipe bowl cleaner but to be slightly cammed around the ovate lighter body and gently snap into non-functional position when mated with the matching curved portion of the lighter body, as can be appreciated in the FIG. 2 showing.

In operation, the pipe smoker mounts the kit on the body of the lighter in the manner above described. When preparing a pipe for use, tamp 16 is rotated counterclockwise and spade 14 clockwise, to the dot and dash positions shown in FIG. 1, by applying adequate pressure to each in opposite directions. Spade 14 will be used to clean out the inside of the pipe bowl (not shown) from unwanted ash and old tobacco. Fresh tobacco may then be entered into the pipe bowl and tamp 16 is then used to compress that tobacco within the bowl. Spade 14 and tamp 16 are then rotated back to the full line position of FIGS. 1 and 2. The lighter mechanism may now be operated to produce a flame which serves to light the freshly introduced tobacco in a well known manner.

Figure 4:
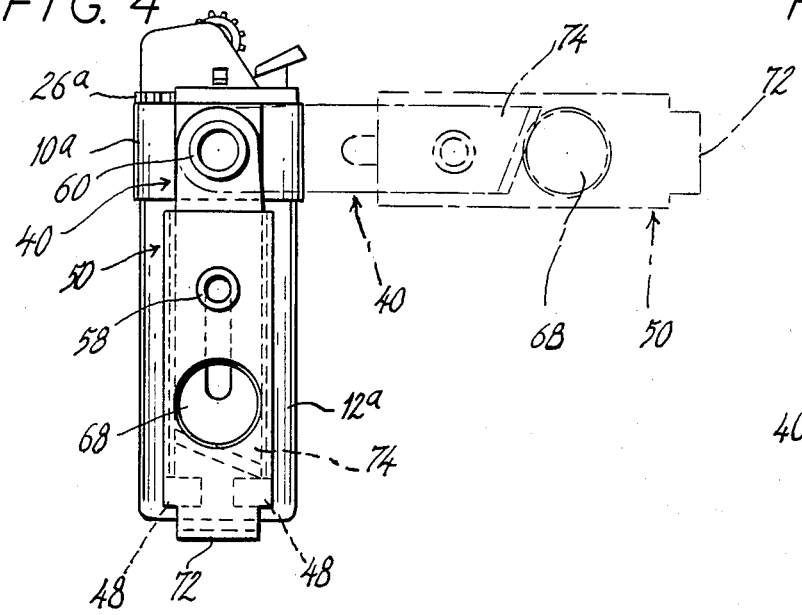
FIG. 4 is a modification of the apparatus shown in FIG. 1 and illustrates a cigar clipper kit assembly mounted on the same type oval-shaped lighter housing; the dot and dash lines illustrating the clipper apparatus poised for operation.
Figure 5:
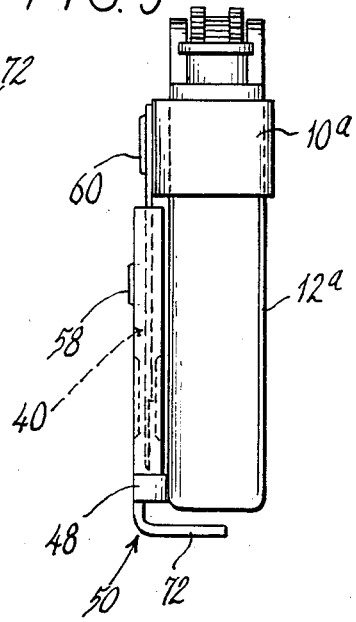
FIG. 5 is a front elevational view illustrating the kit of FIG. 4 detented in home or rest position.
Figure 6:
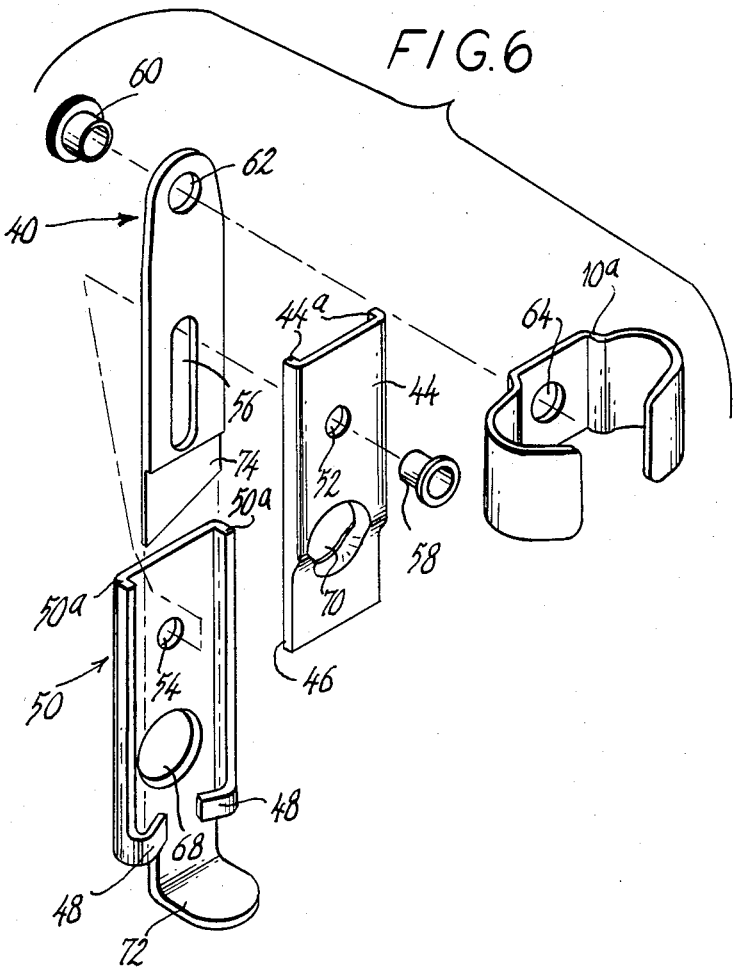
FIG. 6 is an exploded perspective view of the cigar clipper kit, the elements of the invention viewed from the opposite side of the FIG. 4 showing.

Referring now to FIGS. 4–6, a modification of the smoker's kit is provided. This embodiment allows a smoker to have an additional convenient kit in hand that will serve to clip the cigar end and also light the cigar.

As best shown in FIG. 6, the same type of open ended spring clip 10*a* is utilized for mounting the clipper kit to the body 12*a* of lighter mechanism 15*a*. To achieve, a guillotine-like blade member 40 mounts between a pair of flanges 44*a* formed on a cover member 44. A slightly narrowed end 46 of this sub-assembly is then inserted between a pair of retaining tabs 48 formed on a clipper slide 50. A bore 52 in cover 44 is then aligned with a bore 54 in slide 50 and an elongated slot 56 provided in blade 40. Flanges 44*a* on cover 44 are fitted within a pair of flanges 50*a* on slide 50. An eyelet 58 is then inserted through bore 54, elongate slot 56 of blade 40 and bore 52 of cover 44. The eyelet is rolled over to secure those members and thereby provide a clipper assembly. Slide 50 and cover 44 will become slideable with respect to stationary blade 40. The slideable members will be limited in travel by slot 56 in blade 40 as illustrated in the full line and dot and dash showing in FIG. 4. To complete the clipper unit, an eyelet 60 is then inserted through a bore 62 provided in blade 40 and a bore 64 provided in spring clip 10*a*. Eyelet 60 is then rolled over to provide a pivotal mount for the cigar smoker's kit and unite the assembly. Spring clip 10*a* may then be entered at the lower portion of the lighter body 12*a* and forced upwardly to home positon determined by the flame adjusting wheel 26*a* of the lighter mechanism.

In operation, to clip a cigar end, the user may pivot the cigar clipper assembly 90 degrees out of the detented or fufll line position of FIG. 4. Clipper slide 50 and cover member 44, fast with slide 50 may then be extended their full limit as determined by slot 56 in blade 40 and illustrated in dot and dash line of FIG. 4. A cigar end (not shown) may then be inserted with one hand into large bores 68 in slide 50 and 70 in cover 44. Bores 68 and 70 are aligned and each may be slightly beveled to facilitate such entry of the cigar end. The lighter body 12*a* may then be held in a pistol-like fashion with the other hand while the index finger of that hand may serve to engage a bent tab 72 of clipper slide 50 and pull same as a trigger to thereby cause a knife edge of blade 40 to clip off the cigar end. It should here be noted that the narrowed end portion 46 of cover 44 is so formed to better confine the reduced blade end 74 of blade 40 and thereby enables a smooth and clean severance during a clipping action.

Finally, the clipper assembly may now be restored to the full line position of FIGS. 4 and 5 and the lighter mechanism operated to light the freshly clipped cigar.

Having described the invention, I claim:

1. A composite smoker's kit comprising at least one smoker's tool for preparing smoking material in combination with a disposable smoker's lighter, said lighter having an elongated lighter body wherein said body has a substantially ovate transverse cross-section, first means for removingly securing said at least one smoker's tool to said lighter body comprising a spring clip, second means pivotally mounting said at least one smoker's tool to said spring clip, and third curvature means formed on said at least one tool for contacting the lighter body when the longitudinal axis of each of the at least one tool and the lighter body are substantially parallel to provide a detent home position for the at least one tool.

2. The combination of claim 1 wherein the at least one tool includes a spade member and a tamp member, both of which are pivotally mounted to the spring clip, and wherein said third curvature means is formed on said spade member.

3. The combination of claim 1 wherein the at least one tool includes a cigar clipping means comprising a clipping blade slideably mounted in a slide assembly, only said clipping blade being secured to said second mounting means, said third curvature means being formed on said slide assembly, and the slide assembly having a bore therein to receive a cigar end to be clipped.

4. The combination of claim 3 wherein the clipping blade is provided with an elongate slot and the slide assembly with means for protruding into said slot, thereby serving to guide the slide assembly during the clipping operation.

* * * * *